US006408490B1

(12) United States Patent
Pequignet

(10) Patent No.: US 6,408,490 B1
(45) Date of Patent: Jun. 25, 2002

(54) WRISTWATCH QUICK FIXING DEVICE

(75) Inventor: Emile Pequignet, Fournets-Luisans (FR)

(73) Assignee: Montres Pequignet, Morteau (FR)

( * ) Notice: Subject to any disclaimer, the term of this patent is extended or adjusted under 35 U.S.C. 154(b) by 0 days.

(21) Appl. No.: 09/600,613

(22) PCT Filed: Dec. 23, 1998

(86) PCT No.: PCT/FR99/02873

§ 371 (c)(1),
(2), (4) Date: Sep. 5, 2000

(87) PCT Pub. No.: WO99/36838

PCT Pub. Date: Jul. 22, 1999

(51) Int. Cl.[7] ..... A44B 11/00; A44C 5/24

(52) U.S. Cl. ..... 24/265 WS; 24/68 J; 24/71 J; 24/265 B

(58) Field of Search ..... 24/265 WS, 265 B, 24/71 J, 69 J, 68 J, 656

(56) References Cited

U.S. PATENT DOCUMENTS

| | | | | | |
|---|---|---|---|---|---|
| 2,582,828 A | * | 1/1952 | Hajos et al. | ..... | 24/265 WS |
| 3,238,588 A | * | 3/1966 | Sand | ..... | 24/265 WS |
| 4,748,604 A | * | 5/1988 | Lambert | ..... | 24/71 J |
| 5,457,860 A | * | 10/1995 | Miranda | ..... | 24/71 J |
| 5,647,518 A | * | 7/1997 | Baumgartner et al. | . | 24/265 WS |
| 5,771,543 A | * | 6/1998 | Froidevaux et al. | ..... | 24/71 J |

FOREIGN PATENT DOCUMENTS

| | | | | |
|---|---|---|---|---|
| CH | 0172421 | * 10/1934 | ..... | 24/264 WS |
| CH | 0251968 | * 11/1947 | | |
| CH | 0259905 | * 7/1949 | ..... | 24/265 WS |
| DE | 0959859 | * 2/1957 | ..... | 24/265 WS |
| EP | 0344620 | * 12/1989 | ..... | 24/265 WS |

* cited by examiner

*Primary Examiner*—Victor Sakran
(74) *Attorney, Agent, or Firm*—Niles & Niles SC

(57) ABSTRACT

A quick fastening device for fastening an end of a band to a case of a watch includes a band linking element attached to the band and a case linking element attached to the case. The band and the case linking elements mutually interlock with each other and at least one of the band or the case linking elements is movably mounted on the band or the case to which it is interlocked between at least one open position and one closed position. The band and the case linking elements are positioned respectively free for interlocking with respect to each other and fastened by interlocking with respect to each other.

17 Claims, 3 Drawing Sheets

WRISTWATCH QUICK FIXING DEVICE

BACKGROUND OF THE INVENTION

This invention consists of a quick fastening device for wristwatches geared towards quickly locking each end of a watchband to the watch case.

The invention is particularly beneficial to the watchmaking industry.

In the industry, there are actually many quick-change systems that can fasten a watchband rapidly to the watch case to give the watchband an interchangeability feature.

Most known devices use essentially the same operating principle. Schematically, this consists first of attaching together two linking elements to the watchband and the watch case respectively. Then the linking element forming the casing with the locking mechanism should be at least partially blocked to secure the attachment made previously.

The disadvantage of these types of quick-change systems, however, is that they are not esthetically appealing when the locking mechanism is small since its presence inevitably unbalances the watch's otherwise balanced appearance. The reduced size of the various parts used for fastening also makes them unreliable.

When the locking mechanism is of a similar size to that of the watch, other problems arise; namely, that of integrating the locking mechanism to the watch case. In fact, such an adaptation requires subsequent structural and/or formal modifications to the width of the watch, thereby increasing its selling price significantly. This configuration may also be detrimental to the watch's overall look since the presence of a large locking mechanism greatly affects the esthetics of the device and can limit the variations in form. Furthermore, adapting such a quick fastening device to a pre-existing watch would be difficult. In fact, the reverse approach is preferable, that is, to design the watch in view of the fastening system that is to be applied.

In addition to these major inconveniences, the fastening devices previously mentioned are often deemed impractical to implement, thereby making them much less appealing to the clients for whom they are designed. These devices rarely offer both speed and reliability because one feature is always achieved systematically at the cost of the other.

Furthermore, the technical problem to be resolved by this invention is proposing a quick fastening device, geared towards attaching the end of a watchband to the watch case, in which the fastening device is equipped with a linking element attached to the watchband and a second linking element attached to the watch case, where the two linking elements can be secured by fitting them together. This would avoid the problems associated with the current techniques by offering quick action and reliability while being fully adaptable, reasonably priced, and more esthetically appealing.

SUMMARY OF THE INVENTION

With this invention, the solution to the technical problem posed consists of assembling one of the linking elements in an adjustable fashion onto the element to which it is attached, in a place between a designated "open" position and a designated "closed" position. The linking elements can be assembled freely in relation to each other and solidly by attaching them into each other.

In the "open" position, the two linking elements are independent of each other; that is, they can be engaged or disengaged freely in at least one direction. In the "closed" position, however, and assuming that they were previously assembled through a process of joining the elements one into the other, the elements are permanently linked since each direction is conveniently locked.

The linking element's mobility is in any direction, insofar as an "open" and "closed" position exist, as previously defined. Furthermore, the adjustable linking element may also be moved by a sideways motion and a rotating motion, or through a combined, more or less complex motion.

The adjustable linking element can be assembled conveniently on any of the parts to be assembled. Moreover, the term "element" throughout this text designates either the watch case or the watchband, depending on whether the adjustable linking element is attached to the watch case or watchband.

One of the characteristic features of this invention is that the adjustable linking element constitutes the female part of the attachment in the assembly of the two linking elements, through at least a partial penetration. It is thus equipped with at least one casing that can accommodate a protuberance of an essentially complementary form, and which is assembled onto the other linking element that constitutes the male part. The specific nature of the linking element, combined with its mobility in relation to the element to which it is attached, allows easy definition of at least one "open" and one "closed" position, in which each respective female part casing would be free to be blocked by a portion of the surface of the male element in question.

Although the linking element is mobile in any type of motion, the same does not hold true for the lateral direction of movement. Moreover, based on another characteristic feature of the invention, the linking element's mobility is essentially perpendicular to the plane of the element to which the adjustable linking element is attached.

This configuration offers maximal resistance to mechanical stresses exerted between the watch case and watchband during a watch's normal use. In other words, we are referring here to tensile forces. The goal is evidently to prevent any unnecessary movement of the adjustable linking element and thus avoid any risk of sudden disengagement. Making systematical provisions for locking devices to secure the adjustable linking element in a "closed" position is thus unnecessary.

Due to its essentially transversal movement, in relation to the direction in which most of the mechanical stresses are exerted between the watch case and watchband, the adjustable linking element, in fact, effectively withstands all forces that can propel it into an open position, similar to disengagement. In this invention, the adjustable linking element shifts in a direction where the mechanical stresses are the weakest and even virtually non-existent, under normal conditions of use.

Based on a current manufacturing method, currently adopted for the invention, the linking elements can be attached by fitting them together, essentially in a direction perpendicular to the line along which the linking element is assembled while allowing lateral movement. The linking elements' direction of engagement and disengagement is essentially oriented in a parallel fashion to the line along which most of the mechanical stresses are exerted between the watch case and watchband.

Furthermore, the fastening device can naturally withstand the tensile stress exerted between the watch case and watchband since the linking elements can be attached conveniently by fitting them together along the direction of engagement that corresponds to a corresponding disengagement of the watch case from the watchband.

Lastly, since the linking elements direction of engagement and disengagement, when in a "closed" position, is essentially perpendicular to the surface portion of the element that is in contact with the adjustable linking element, any accidental disengagement of the said linking elements would thus appear impossible. In fact, the surface portion of the supporting element forms an actual stop that can prevent access to the various casings on the adjustable linking element, and which are geared towards accommodating the male parts of the other linking element. In fact, the disengagement of the linking elements is totally controlled by the position of the adjustable linking element in relation to the supporting element to which it is attached.

The advantage to this invention, as defined, is its simple design since it does not require any specific locking device to secure the linking elements together, thus allowing the band to be quickly fastened to the watch. In this case, the locking function is carried out conveniently by the surface portion of the watch case, towards which the adjustable linking element is forced to move and/or position itself, once it is in a "closed" position. This simple concept evidently results in increased reliability, quick action and a reasonable selling price.

Based on another manufacturing method for the invention, the linking elements can be attached essentially parallel to the direction in which the linking element is assembled, and in an adjustable fashion. Thus, the directions of engagement and disengagement of the adjustable linking elements are conveniently oriented and practically perpendicular to the direction along which most of the mechanical stresses are exerted between the watch case and watchband. In this way, the fastening device can naturally and effectively withstand the tensile stress, and eventually the pressure, exerted between the watch case and watchband.

However, with this configuration, making provisions for specific devices to secure the linking elements is essential. In fact, the securing function can no longer be carried out by the surface portion of the element to which the linking element is assembled while allowing lateral movement, as in the first manufacturing method. In this case, the surface portion in question, as well as the direction of engagement and disengagement, are essentially parallel, which prevents the surface portion from acting as a stop.

Moreover, the second manufacturing method of the invention ensures that the element supporting the adjustable linking element is equipped with at least one component creating a stop, and cooperating by making contact with the adjustable linking element when it is in the "closed" position. The component creating the stop extends essentially perpendicular to the direction of engagement and disengagement of the linking elements.

Regardless of the manufacturing method used, and regardless of the fact that this may not be essential, the quick fastening device, which is the object of this invention, can be equipped with locking devices that can maintain the adjustable linking element in the "closed" position. The purpose of this additional safety feature is to make the fastening device even more reliable.

BRIEF DESCRIPTION OF THE DRAWINGS

The following description, concerning the drawings annexed hereto and provided as open-ended examples, will describe the invention and how it can be manufactured.

DESCRIPTION OF THE PREFERRED EMBODIMENT

For the purposes of clarity, identical references were used to designate the same elements. Similarly, only the essential elements needed to understand the invention were illustrated and without taking into account scale or schematic format.

Figure 1:
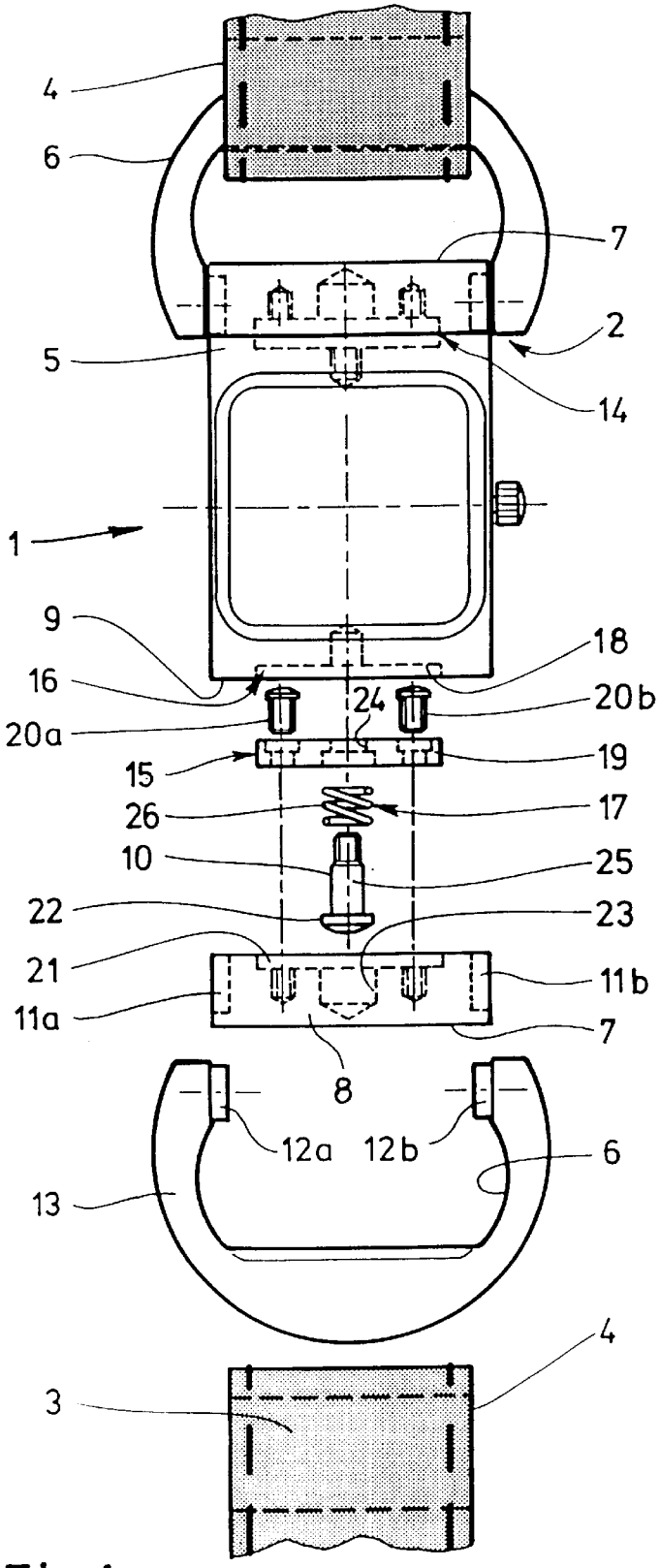
FIG. 1 is a top view of a wristwatch equipped with quick fastening devices, according to the first manufacturing method of the invention.
Figure 2:
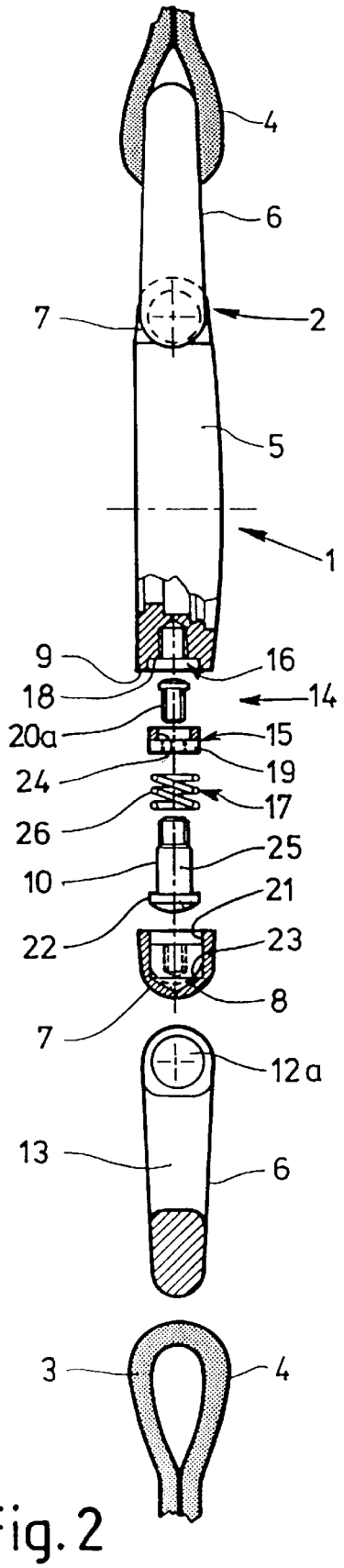
FIG. 2 is a side sectional view of the wristwatch illustrated in FIG. 1.

As shown in FIGS. 1 and 2, the wristwatch (1) is equipped with two quick fastening devices (2), that are perfectly identical and symmetrical. Each of them is designed to fasten one end (3) of the watchband (4) to the case (5) of the watch (1). To do this, each fastening device (2) is equipped with two linking elements (6, 7) that can be attached to each other. The first is attached to the watchband (4) and constitutes the male part of the attachment, while the second is attached to the watch case (5) and acts as the female part.

With this specific manufacturing method, the linking element (7) is assembled, allowing lateral movement between a "closed" position and a multitude of "open" positions in which the two linking elements (6, 7) can be assembled freely and solidly by fitting them together. The movement of the linking element (7) is in a rotating motion, parallel to the case (5). Thus, the linking element (7) is able to move in a perpendicular direction to the mechanical stresses that are exerted between the watch case (5) and watchband (4).

The linking element (7) in this case is illustrated in the form of a bar (8) assembled transversally, and rotationally adjustable, on one side (9) of the watch case (5), using the pivot (10) attached to the watch case (5). Each bar end (8) is equipped with a casing **(11*a*, 11*b*) that can be fastened by attaching it with one of the two protuberances (12*a*, 12*b*) of an essentially complementary form and supported by the other linking element (6)**.

The linking element (6) is shown as a U-shaped part (13) that can be assembled in a detachable fashion on the end (3) of the watchband (4) because it can be inserted through the end (3). This distinct feature makes it possible to change only the watchband (4); that is, only one linking element (6) is required regardless of the number of watchbands available. Moreover, the two protuberances **(12*a*, 12*b*) are assembled on the ends of the U-shaped part (13)**.

The attachment of the linking elements (6, 7) is carried out in a direction perpendicular to the plane along which the adjustable linking element (6) is forced to move, depending on the direction of engagement which corresponds to the corresponding disengagement of the watchband (4) from watch case (5). It is for this reason that openings of the casings **(11*a*, 11*b*) are directed towards the watch case (5,) and that they can consequently be blocked by the surface portion of the side (9) when the adjustable linking element (7)** is in the "closed" position.

To ensure that the adjustable linking element (7) is secured against the side (9) of the watch case (5), locking devices (14) that can secure the rotating movement of the adjustable linking element (7) were conveniently placed.

They include two locking mechanisms (15, 16), whose forms are essentially complementary, and which are assembled respectively on the adjustable liking element (7) and on the element (4, 5) supporting the adjustable linking element (7). Moreover, the two locking mechanisms (15, 16) can be attached together, using an elastic recall device (17), when the adjustable linking element (7) is in the "closed" position.

As shown precisely in the manufacturing method illustrated in FIGS. 1 and 2, the locking mechanism (16) constitutes a groove (18) that creates the slot which is cut directly into the side (9) of the watch case (5). The locking mechanism (15) is made up of the plate (19) forming the stud, which is assembled in a detachable fashion on the bar (8) using two locking screws (20*a*, 20*b*). To ensure that the plate (19) is positioned perfectly on the bar (8), the bar has a groove (21) with a form that complements the part of the plate (19) that cannot be fitted into the groove (18) on the watch case (5). The grooves (18 and 21) therefore conveniently offer increased capacity that corresponds precisely to the overall dimensions of the plate (19). On the one hand, this ensures perfect positioning of the plate (19) into the groove (18) when going into the "closed" position. On the other hand, it ensures close contact between the bar (8) and the watch case (5).

The engagement or disengagement of the locking mechanisms (15, 16) is executed by a lateral movement along the axis around which the adjustable linking element (7) is assembled in a pivoting fashion. With this objective, the bar (8) is assembled in a laterally adjustable fashion in relation to the pivot (10). In concrete terms, the pivot is equipped with a head (22) that can slide axially within a cylindrical recessed hole (23), positioned transversally in the bar (8) and having the same diameter as the head (22). Moreover, the head (22) is locked into the recessed hole (23) due to the fact that its opening is covered partially by the plate (19), which, in fact, reveals at this specific location, a transversal hole (24) with a smaller diameter since it corresponds to the diameter of the body (25) of the pivot (10).

As previously mentioned, it must be noted that with this configuration, the bar (8) can be freely rotated in relation to the pivot (10), which is responsible for the linking element's (7) mobility.

To ensure that the locking mechanisms (15, 16) engage, an elastic recall device (17) is illustrated, in this case in the form of a compression spring (26), that positions itself around the body (25) of the pivot (10), between the head (22) and the inner side of the plate (19). The action of the spring (26) can only be applied to the bar (8), which is assembled in an adjustable fashion, in an axial lateral motion, and the head (22) is considered to be fixed since the pivot (10) is attached to the watch case (5). The adjustable linking element (7) is thus forced to move towards the side (9), which causes the locking mechanisms (15, 16) to penetrate one another when they are perfectly aligned, as is the case when in the "closed" position.

Figure 3:
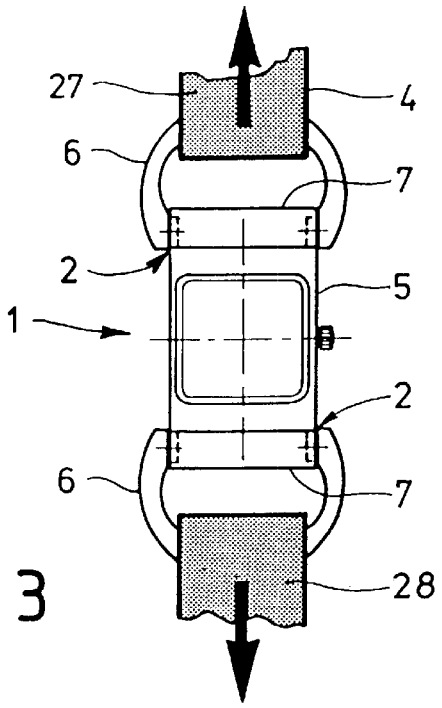
FIGS. 3 to 5 are top views illustrating the operating principle of the quick fastening devices on the wristwatch shown in FIGS. 1 and 2.
Figure 4:
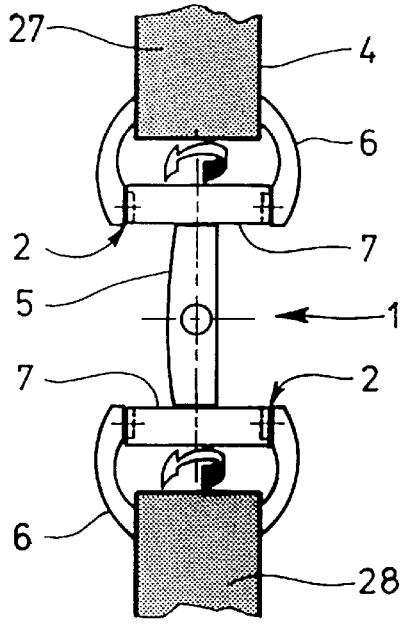
Figure 5:
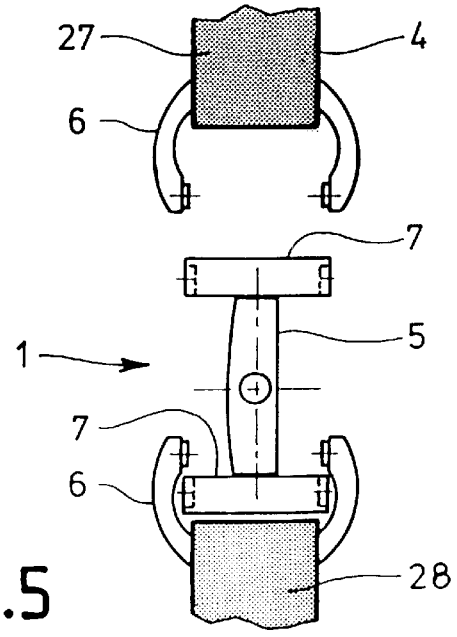

As shown in FIGS. 3 to 5, any disconnecting action of the band (4) from the watch, illustrated in FIGS. 1 and 2, is extremely simple. According to FIG. 3, it involves exerting a pull on each part (27, 28) of the watchband (4) to open the locking mechanisms (15, 16) and allowing the two adjustable linking elements (7) to leave their "closed" positions. Secondly, the adjustable linking elements (7) in question are swiveled around in relation to the watch case (5) until an "open" position is reached that can disengage the male and female parts which were attached together. The open position illustrated in FIG. 4 only represents one of many possibilities in which the watch case (5) and watchband (4) are positioned perpendicular in relation to each other. Thirdly, the linking elements (6,7) are separated according to FIG. 5. It is then possible to remove each linking element (6) from each part (27, 28) of the watchband (4) and to re-insert them into the respective ends of a new watchband. Re-assembly is subsequently carried out by proceeding in the reverse order; that is, by re-engaging the linking elements (6,7), by swiveling the adjustable linking elements (7) around, and subsequently by allowing the locking mechanisms (15,16) to lock automatically through the action of the elastic recall device (17).

During the unlocking process illustrated in FIG. 3, the pull exerted on each fastening device (2) causes the bar (8) to slide axially along the pivot (10). The spring (26) is then compressed by bringing together the plate (19) and the head (22). Once the locking mechanisms (15,16) are disconnected, that is, when the plate (19) has completely withdrawn from the groove (18), the bar (8) can turn freely around the pivot (10). This movement is fully guided due, on the one hand, to the fact that the head (22) is in contact with the recessed hole (23) and, on the other hand, that part of the body (25) of the pivot (10) is also in contact with the transversal hole (24). Once the desired "open" position is reached, as shown in FIG. 4, the linking elements are disconnected from each other by bringing the watch case (5) and watchband (4) closer together, as in FIG. 5.

Figure 6:
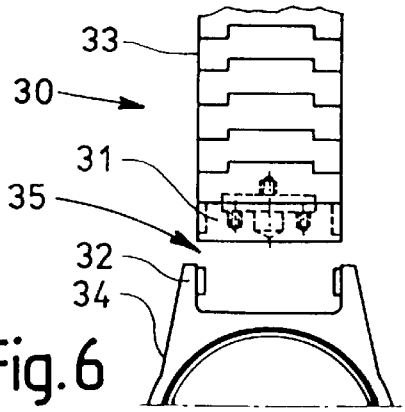
FIG. 6 is a top view of a wristwatch, according to the second manufacturing method of the invention.

The wristwatch (30) partially illustrated in FIG. 6 only constitutes a simple manufacturing variation, in which the respective positions of the linking elements (31, 32) were simply reversed compared to the same parts in the first manufacturing method described. The adjustable linking element (31) is, in fact, now the one that is attached to the watchband (33). However, this quick fastening device (35) is still fundamentally identical to those illustrated in FIGS. 1 to 5 with regard to both its basic structure and operating principle. This case illustrates the rotating movement of the adjustable linking element (31) and the attachment process of the linking elements (31, 32) in a direction perpendicular to the line along which the adjustable linking element (31) moves in order to go from a "closed" to an "open" position or vice versa. The only notable structural differences involve integrating the linking element (32) to the watch case (34), which requires some modifications. The male parts forming the studs are similar, while the structure of the adjustable linking element (31), as well as that of the locking mechanisms, are perfectly identical to their counterparts.

Figure 7:
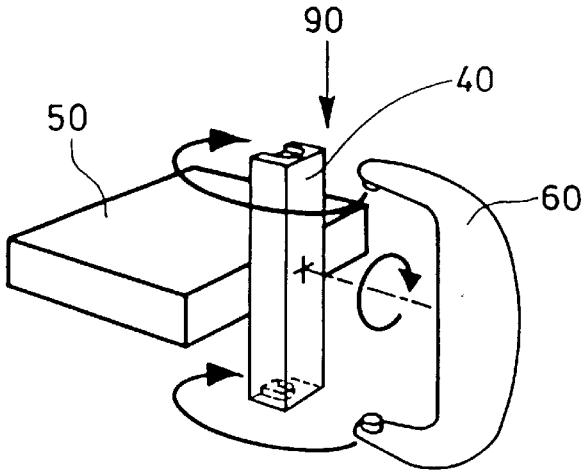
FIGS. 7 to 10 are diagrams illustrating manufacturing variations of the invention.
Figure 10:
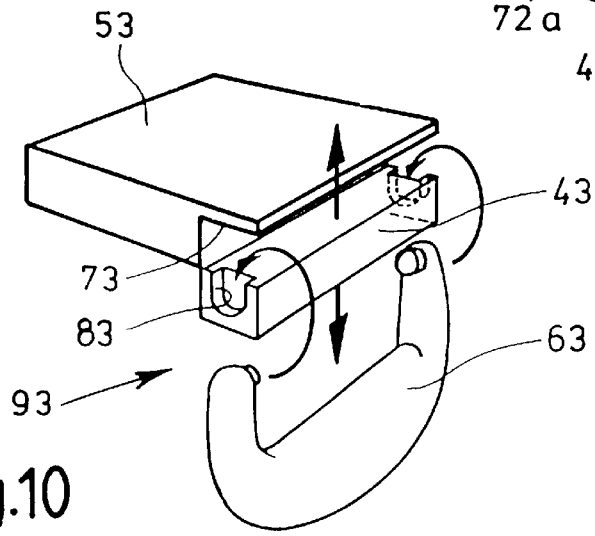

FIGS. 7 and 10 clearly illustrate schematically some of the manufacturing variations possible by the skilled watchmaker. For each quick fastening device (90, 91, 92, 93), the adjustable linking element (40, 41, 42, 43) was deliberately selected as the one that is attached to the watch case (50, 51, 52, 53). Evidently, it is possible to consider other manufacturing methods simply by retaining the same principle but by opting for an adjustable linking element attached to the watchband.

FIG. 7 corresponds to the first manufacturing method described; that is, a quick fastening device (90), equipped with an adjustable linking element (40) which is able to rotate, and for which the attachment with the related linking element (60) is realized by an essentially perpendicular movement to the mobility plane of the first adjustable linking element (40).

Figure 8:
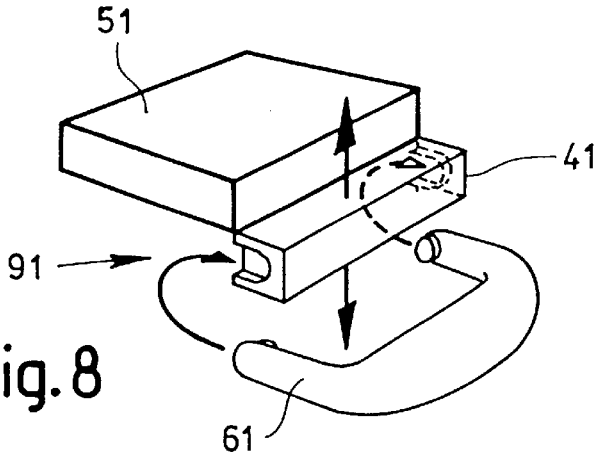

In the case of FIG. 8, the adjustable linking element (41) can move in transversally. Again, it is attached to the other linking element (61) by a movement essentially perpendicular to the mobility plane of the first adjustable linking element (41).

Figure 9:
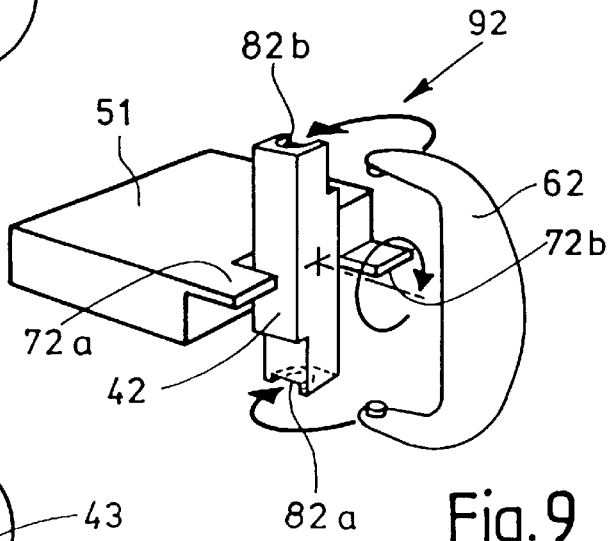

The following two variations, illustrated in FIGS. 9 and 10, distinguish themselves from the preceding two by the fact that the attachment process of the linking elements (42, 43; 62, 63) in this case, is by a movement parallel to the mobility plane of the adjustable linking element (42, 43). On the contrary, in this case, the adjustable linking element (42,43) has both types of mobility; that is, rotational movement as in FIG. 9 and transversal movement as in FIG. 10.

In the last two manufacturing methods, specific measures were designed to lock the linking elements (42, 43; 62, 63) together. In the simplest example, that is, the transversal movement illustrated in FIG. 10, the watch case (53) is equipped with an edge (73) extending perpendicular to the direction of engagement of the linking elements (43, 63), and opposite in relation to the direction of disengagement. Moreover, the length of the edge (73) is comparable to that of the adjustable linking element (43) so that, in the "closed" position, access to casings (83) assembled on it is completely blocked by the edge (73).

In the case of FIG. 9, where the linking element (42) is assembled in a rotationally adjustable fashion, the watch case (52) must be equipped with two lugs (72*a*, 72*b*) which create the stops to lock the two casings (82*a*, 82*b*) assembled on the two opposing sides of the adjustable linking element (42). To achieve this, the two lugs (72*a*, 72*b*), which extend perpendicular to the direction of engagement of the linking elements (42, 62), are assembled respectively on both the top and bottom surfaces of the watch case (52).

What is claimed is:

1. A quick fastening device for fastening an end of a band to a case of a watch comprising:

a band linking element attached to the band;

a case linking element attached to the case, wherein the band and the case linking elements mutually interlock with each other and at least one of the band or the case linking elements is movably mounted on the band or the case to which it is interlocked between at least one open position and one closed position; and wherein the band and the case linking elements are positioned respectively free for interlocking with respect to each other and fastened by interlocking with respect to each other.

2. A quick fastening device according to claim 1 wherein the adjustable case linking element constitutes a female part of the attachment process corresponding to the assembly of the case linking element and the band linking element by at least a partial penetration.

3. A quick fastening device according to claim 2 wherein movement of the case linking element is substantially perpendicular to the plane alone which the band linking element or the case linking element extends and to which the adjustable case linking element is attached.

4. A quick fastening device according to claim 3, wherein the band linking element or the case linking element are attached together in a substantially perpendicular manner to the direction along which the adjustable case linking element is assembled while allowing lateral movement.

5. A quick fastening device according to claim 4, wherein the band linking element or the case linking element are attached together in a direction that corresponds to a corresponding disengagement of the case and the band.

6. A quick fastening device according to claim 5, wherein in the closed position, the direction of engagement and disengagement of the band linking element and the case linking element is substantially perpendicular to a surface portion of the band or the case that is in contact with the adjustable case linking element.

7. A quick fastening device according to claim 1, wherein the band linking element and the case linking element are attached together in an essentially parallel manner to the direction along which the case linking element is assembled while allowing a lateral movement.

8. A quick fastening device according to claim 7, wherein the case supporting the adjustable case linking element includes a stop, wherein in the closed position the stop contacts the adjustable case linking element and the stop extends substantially perpendicular to the direction of engagement and disengagement of the band linking element and the case linking element.

9. A quick fastening device according to claim 8, wherein the band linking element and the case linking element are attached together in a direction of engagement that corresponds to a corresponding disengagement of the band linking element that is not adjustable and the stop of the case linking element.

10. A quick fastening device according to claim 9 further comprising a locking device that maintains the adjustable case linking element in the closed position.

11. A quick fastening device according to claim 10, wherein the locking device includes a pair of locking mechanisms of a substantially complementary form, wherein the pair of locking mechanisms are assembled respectively on the adjustable case linking element and on the band and case supporting the adjustable case linking element, wherein the pair of locking mechanisms are attached together through the action of an elastic recall device when the adjustable case linking element is in the closed position.

12. A quick fastening device according to claim 11, wherein the band linking element is detachably fixed to an end of the band and includes a U-shaped element that is inserted through the end of the band.

13. A quick fastening device for fastening an end of a band to a case of a watch comprising:

a band linking element attached to the band;

a case linking element attached to the case, wherein the band and the case linking elements mutually interlock with each other and at least one of the band or the case linking elements is movably mounted on the band or the case to which it is interlocked between at least one open position and one closed position;

wherein the band and the case linking elements are positioned respectively free for interlocking with respect to each other and fastened by interlocking with respect to each other; and wherein the adjustable case linking element constitutes a female part of the attachment process corresponding to the assembly of the case linking element and the band linking element by at least a partial penetration.

14. A quick fastening device according to claim 13, wherein the band linking element or the case linking element are attached together in a substantially perpendicular manner to the direction along which the adjustable case linking element is assembled while allowing lateral movement.

15. A quick fastening device according to claim 14, wherein the band linking element or the case linking element are attached together in a direction that corresponds to a corresponding disengagement of the case and the band.

16. A quick fastening device according to claim 15, wherein in the closed position, the direction of engagement and disengagement of the band linking element and the case linking element is substantially perpendicular to a surface portion of the band or the case that is in contact with the adjustable case linking element.

17. A quick fastening device according to claim 13, wherein the band linking element and the case linking element are attached together in an essentially parallel manner to the direction along which the case linking element is assembled while allowing a lateral movement.

* * * * *